US009404650B2

(12) United States Patent
Lapierre

(10) Patent No.: US 9,404,650 B2
(45) Date of Patent: Aug. 2, 2016

(54) BOILER WITH IMPROVED HOT GAS PASSAGES

(76) Inventor: M. Alexandre Lapierre, Longueuil (CA)

( * ) Notice: Subject to any disclaimer, the term of this patent is extended or adjusted under 35 U.S.C. 154(b) by 1255 days.

(21) Appl. No.: 12/814,017

(22) Filed: Jun. 11, 2010

(65) Prior Publication Data

US 2010/0326373 A1 Dec. 30, 2010

Related U.S. Application Data

(60) Provisional application No. 61/222,050, filed on Jun. 30, 2009.

(51) Int. Cl.

| | |
|---|---|
| ***F22B 19/00*** | (2006.01) |
| ***F22B 15/00*** | (2006.01) |
| ***F22B 21/24*** | (2006.01) |
| ***F22B 37/22*** | (2006.01) |
| ***F24H 1/41*** | (2006.01) |
| ***F23C 9/08*** | (2006.01) |
| ***F22B 21/34*** | (2006.01) |
| ***F22B 21/30*** | (2006.01) |

(52) U.S. Cl.

CPC ..... *F22B 21/346* (2013.01); *F22B 21/30* (2013.01)

(58) Field of Classification Search

None

See application file for complete search history.

(56) References Cited

U.S. PATENT DOCUMENTS

| | | | | | |
|---|---|---|---|---|---|
| 1,304,499 | A | * | 5/1919 | Meier | 122/235.17 |
| 1,555,435 | A | * | 9/1925 | Rohrer | 122/444 |
| 1,819,179 | A | | 8/1931 | Kerr | |
| 1,948,538 | A | * | 2/1934 | Noack | 122/24 |
| 2,096,184 | A | * | 10/1937 | Lasley | 60/726 |
| 2,553,713 | A | * | 5/1951 | Levis | 122/356 |
| 2,570,073 | A | | 10/1951 | Reintjes | |
| 2,865,342 | A | * | 12/1958 | Rehm | 122/406.1 |
| 2,954,014 | A | * | 9/1960 | Rehm | 122/407 |
| 3,029,797 | A | * | 4/1962 | Rehm | 122/407 |
| 3,125,863 | A | * | 3/1964 | Hood, Jr. | 62/175 |
| 3,399,655 | A | * | 9/1968 | Arant | 122/406.1 |
| 3,518,973 | A | * | 7/1970 | Herzenberg | 122/235.11 |
| 3,664,309 | A | * | 5/1972 | Seelinger | 122/336 |
| 3,736,907 | A | * | 6/1973 | Agrest | 122/2 |
| 3,835,920 | A | * | 9/1974 | Mondt | F28D 7/06 122/510 |
| 3,857,244 | A | * | 12/1974 | Faucette | 60/641.2 |
| 3,910,236 | A | | 10/1975 | Merritt | |
| 4,136,643 | A | * | 1/1979 | Aguet | 122/7 B |
| 4,355,602 | A | * | 10/1982 | Cooke | 122/235.11 |
| 4,499,944 | A | | 2/1985 | Komakine | |
| 4,612,879 | A | * | 9/1986 | Cooke | 122/135.1 |
| 4,633,818 | A | | 1/1987 | Horlitz | |
| 4,691,666 | A | * | 9/1987 | Scherer | A47J 27/17 122/33 |
| 4,993,368 | A | * | 2/1991 | Jones et al. | 122/235.23 |
| 5,005,529 | A | | 4/1991 | Polcer | |

(Continued)

*Primary Examiner* — Gregory Huson
*Assistant Examiner* — Eric Gorman
(74) *Attorney, Agent, or Firm* — Benoît & Côté Inc.

(57) ABSTRACT

The present document describes a boiler for heating a cold fluid with a hot fluid. The boiler comprises a lower drum, an upper drum, a plurality of right tubes for conveying the cold fluid, where each of the right tubes are fluidly connecting the lower drum and the upper drum, where the right tubes form a right wall and where each of the right tubes comprises at least one left inwardly extending portion extending toward a left wall and a plurality of left tubes for conveying the cold fluid, where each of the left tubes fluidly connect the lower drum and the upper drum, and where the left tubes form the left wall facing the right wall, where each of the left tubes comprises at least one right inwardly extending portion, each extending toward the right wall.

17 Claims, 13 Drawing Sheets

(56) References Cited

U.S. PATENT DOCUMENTS

| | | | | | |
|---|---|---|---|---|---|
| 5,029,557 | A * | 7/1991 | Korenberg | 122/149 |
| 5,050,542 | A * | 9/1991 | Cooke | 122/235.23 |
| 5,067,419 | A * | 11/1991 | Kobayashi et al. | 110/234 |
| 5,247,991 | A | 9/1993 | Polcer | |
| 5,311,844 | A | 5/1994 | Polcer | |
| 5,353,749 | A * | 10/1994 | Seibel et al. | 122/240.1 |
| 5,361,751 | A * | 11/1994 | Biggs | 126/101 |
| 5,832,745 | A * | 11/1998 | Klein Nagelvoort et al. | 62/619 |
| 5,870,976 | A * | 2/1999 | Cooke | 122/347 |
| 5,997,283 | A * | 12/1999 | Spiros | 431/178 |
| 6,119,767 | A * | 9/2000 | Kadota et al. | 165/104.33 |
| 6,497,856 | B1 * | 12/2002 | Lomax et al. | 423/651 |
| 6,817,319 | B1 * | 11/2004 | Manay | 122/235.23 |
| 6,901,887 | B2 * | 6/2005 | English | 122/331 |
| 7,137,360 | B1 * | 11/2006 | Zorzit | 122/235.11 |
| 7,220,365 | B2 * | 5/2007 | Qu et al. | 252/70 |
| 7,334,542 | B2 * | 2/2008 | Zorzit et al. | 122/235.19 |
| 2002/0146359 | A1 * | 10/2002 | Lomax et al. | 422/198 |
| 2003/0052181 | A1 * | 3/2003 | Bolster | 237/2 A |
| 2003/0066638 | A1 * | 4/2003 | Qu et al. | 165/186 |
| 2004/0094100 | A1 * | 5/2004 | English | 122/235.11 |
| 2005/0092261 | A1 * | 5/2005 | Newman | 122/1 C |
| 2005/0097819 | A1 * | 5/2005 | Lomax et al. | 48/127.9 |
| 2005/0173102 | A1 * | 8/2005 | Jung | F28D 7/08 165/157 |
| 2006/0272933 | A1 * | 12/2006 | Domen et al. | 203/10 |
| 2007/0193872 | A1 * | 8/2007 | Garcia et al. | 202/234 |
| 2008/0104960 | A1 * | 5/2008 | Lomax et al. | 60/653 |
| 2008/0118413 | A1 * | 5/2008 | Lomax et al. | 422/188 |
| 2008/0196872 | A1 * | 8/2008 | Favier | 165/159 |

* cited by examiner

BOILER WITH IMPROVED HOT GAS PASSAGES

CROSS-REFERENCE TO RELATED APPLICATIONS

This application claims priority under 35USC §119(e) of U.S. provisional patent application 61/222,050, filed on Jun. 30, 2009. For the US only, the specification of the foregoing provisional patent application is hereby incorporated by reference.

TECHNICAL FIELD

This description relates to the field of boilers for heating a fluid. More particularly, this description relates to boilers with tubes.

BACKGROUND

Boilers for heating a cold fluid (e.g. water, steam, thermal oil or any other heating medium) with a hot fluid (e.g. hot gases) with tubes are well known. Many improvements were provided in the past. In order to enhance the efficiency, number of isolated passages was increased by adding separators, plates or baffles among the tubes. These additional parts among the tubes are exposed to the hot fluid and thus require maintenance and decrease the availability of the boiler. These additional parts could also generate noise nuisance.

In order to enhance the efficiency, economizers are provided to be installed outside the boiler for saving energy released in the hot fluid escaping from the boiler. This type of economizer is separated to the boiler and need an external assistance (e.g. pump) for the circulation of the cold fluid trough the economizer. The external assistance consumes energy and thus decreases the global efficiency of the boiler.

Also, the transfer of the hot fluid from one passage to another is done with a particular pattern of tubes at the ends of the passages. That increases the number of types of tube to keep in inventory at the different level of the supply chain.

SUMMARY

According to an aspect, there is provided a boiler for heating a cold fluid with a hot fluid. The boiler comprises: a lower drum; an upper drum; a plurality of right tubes for conveying the cold fluid, each of the right tubes fluidly connecting the lower drum and the upper drum, the right tubes forming a right wall, each of the right tubes comprising at least one left inwardly extending portion extending toward a left wall; and a plurality of left tubes for conveying the cold fluid, each of the left tubes fluidly connecting the lower drum and the upper drum, the left tubes forming the left wall facing the right wall, each of the left tubes comprising at least one right inwardly extending portion, each extending toward the right wall; wherein the at least one right inwardly extending portion is contiguous to and staggered with the at least one left inwardly extending portion, forming at least two passages between the right wall and the left wall, each one of the at least two passages having first and second ends and being substantially isolated from each other between each of its respective first and second ends; in use, the hot fluid circulates in the at least two passages and heats the right tubes and the left tubes, thereby heating the cold fluid.

According to another aspect, there is provided a boiler for heating a cold fluid with a hot fluid. The boiler comprises: a lower drum; an upper drum; a plurality of tubes for conveying the cold fluid, each of the tubes fluidly connecting the lower drum and the upper drum, the tubes forming at least two passages each having first and second ends and being substantially isolated from each other between each of its respective first and second ends; and an end wall disposed at one end of the at least two passages, fluidly connecting the at least two passages; the end wall comprising a cavity allowing the hot fluid passing from one to another of the at least two passages by the cavity, wherein, in use, the hot fluid circulates in the at least two passages and heats the tubes, thereby heating the cold fluid.

According to another aspect, there is provided a boiler for heating a cold fluid with a hot fluid. The boiler comprises: a lower drum; an upper drum; a plurality of tubes for conveying the cold fluid, each of the tubes fluidly connecting the lower drum and the upper drum, the tubes forming a passage having first and second ends; and an additional exchanger; the additional exchanger comprising a cold inlet, a cold outlet, a hot inlet and a hot outlet; the cold inlet being fluidly connected to the lower drum, the cold outlet being fluidly connected to the upper drum, the hot inlet being fluidly connected to one end of the passage for receiving the previously cooled hot fluid; wherein in use, the hot fluid circulates in the passage and heats the tubes, thereby heating the cold fluid, then the hot fluid crosses the additional exchanger and exhausts by the hot outlet, the cold fluid, being subjected to a difference in temperature between the cold inlet and the cold outlet, flows upwardly from the lower drum to the upper drum crossing the additional exchanger thereby heating the cold fluid.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
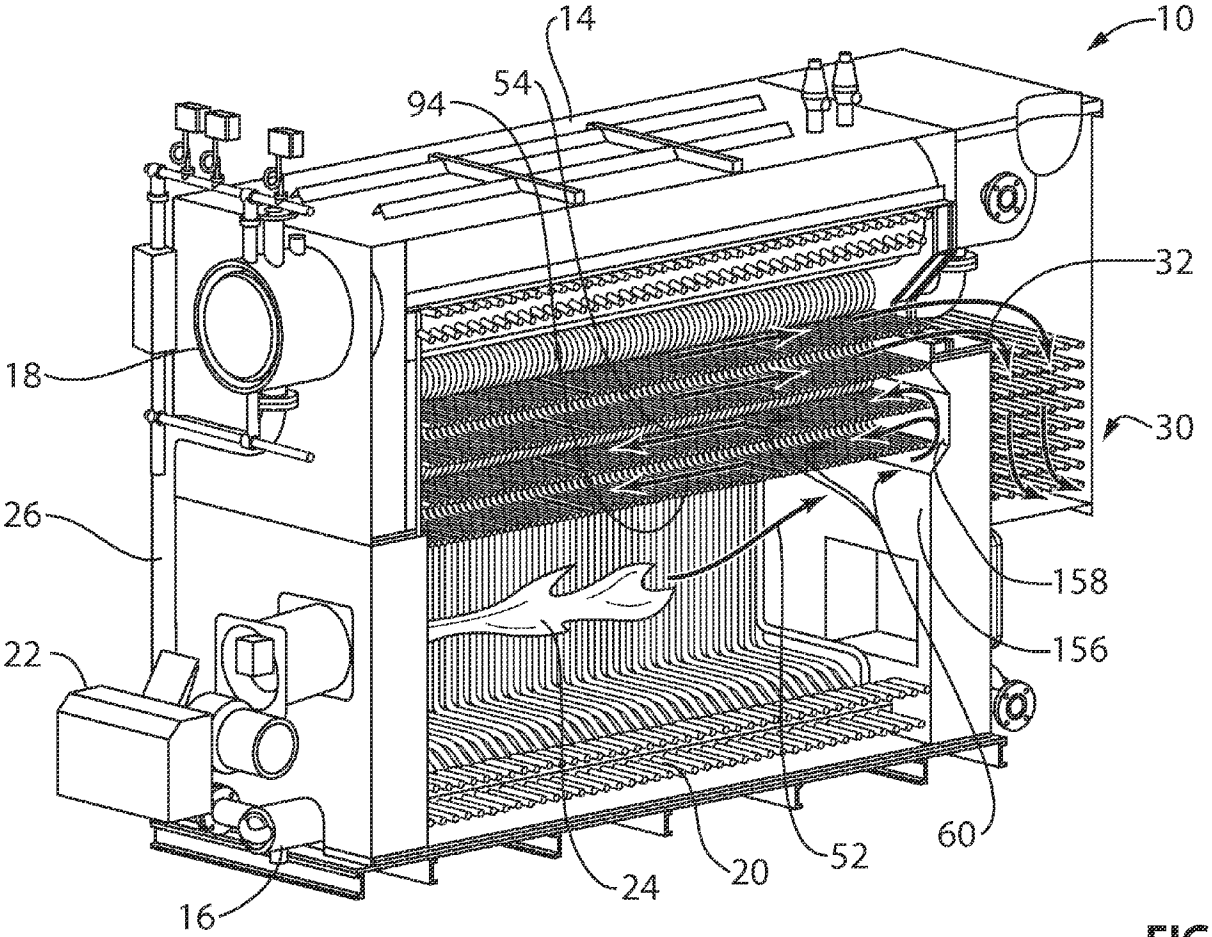
FIG. 1 is a partial cut-out perspective of a boiler 10 in accordance with an embodiment.
Figure 2:
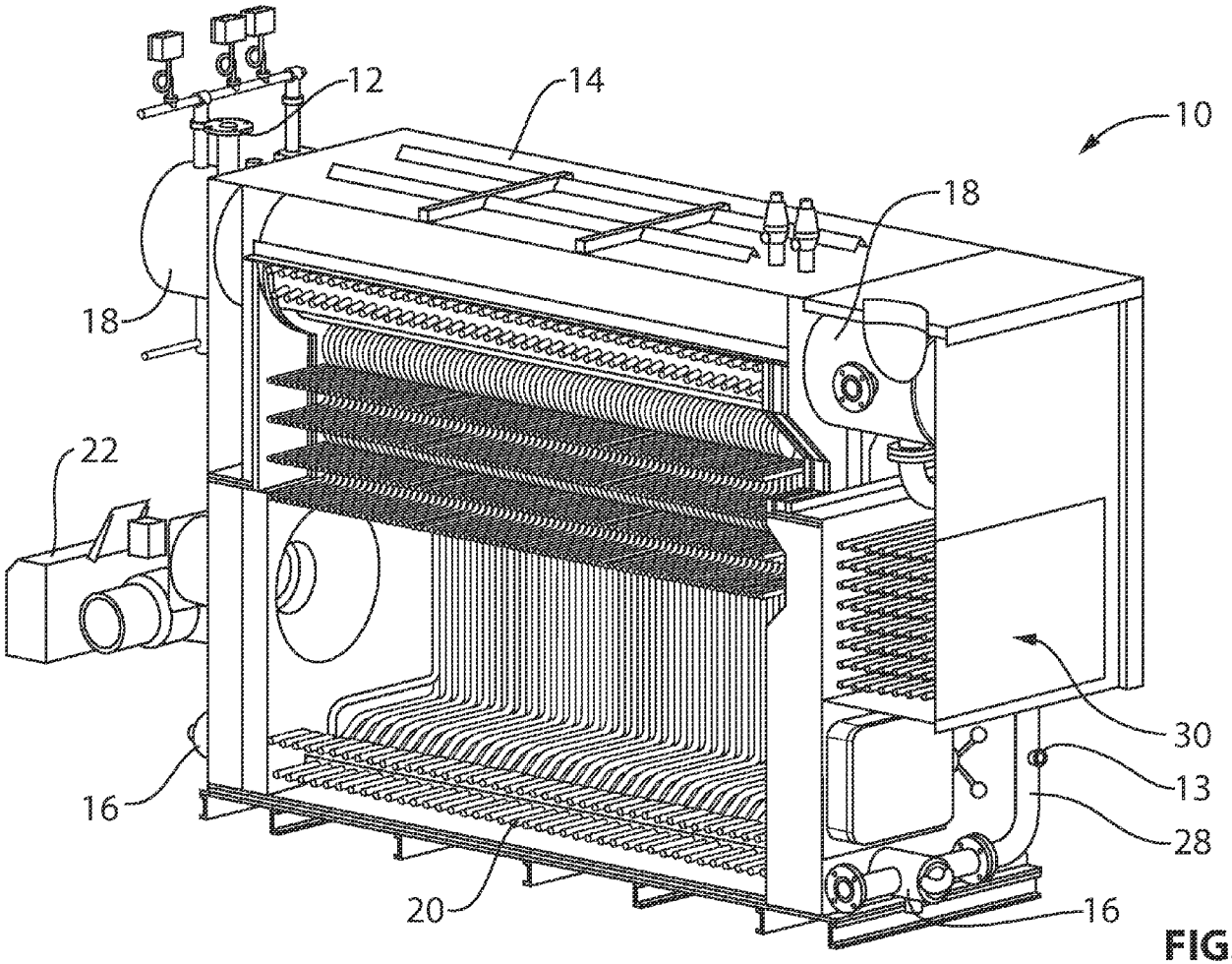
FIG. 2 is another partial cut-out perspective of the boiler 10.

Referring now to the drawings and more particularly to FIG. 1 and FIGS. 2, 3 and 4, there is respectively shown from the front and from the rear a boiler 10 in accordance with an embodiment. The boiler 10 is usually installed in a closed circuit, not shown, for heating a fluid and delivering it through a boiler outlet 12 as an external flow. The fluid circulates in a network comprising radiators, exchangers or turbines which decrease the temperature of the fluid, then the fluid flows back into the boiler 10 through a boiler inlet 76 to be heated again. According to an embodiment, the fluid is warm water or steam; it could also be a high specific heat capacity fluid or other convenient fluid or heating medium.

The boiler 10 comprises a housing 14 enclosing a lower drum 16, an upper drum 18 and a plurality of tubes 20 fluidly connecting the lower drum 16 and the upper drum 18. The boiler inlet is connected to the lower drum 16 and/or to the economizer inlet 62 for receiving the fluid coming from the network which is called the cold fluid. A burner 22 produces a hot fluid 24, usually hot gases from combustion, which circulate among the tubes 20 for heating the cold fluid. The cold fluid being heated in the tubes 20 naturally migrates from the lower drum 16 to the upper drum 18. The lower drum 16 and the upper drum 18 are fluidly connected by a front down corner 26 and a rear down corner 28 for creating a high rate cold fluid internal flow downwardly from the upper drum 18 to the lower drum 16.

At the rear, the boiler 10 comprises an economizer 30, also referred to as an additional exchanger receiving from the top or the bottom hot fluid 32 usually hot gases, previously cooled by the tubes 20. The economizer 30 heats the cold fluid which, due to a difference in temperature between a lower cold fluid inlet and an upper cold fluid outlet, naturally flows from the lower drum 16 and flowing up to the upper drum 18.

Figure 3:
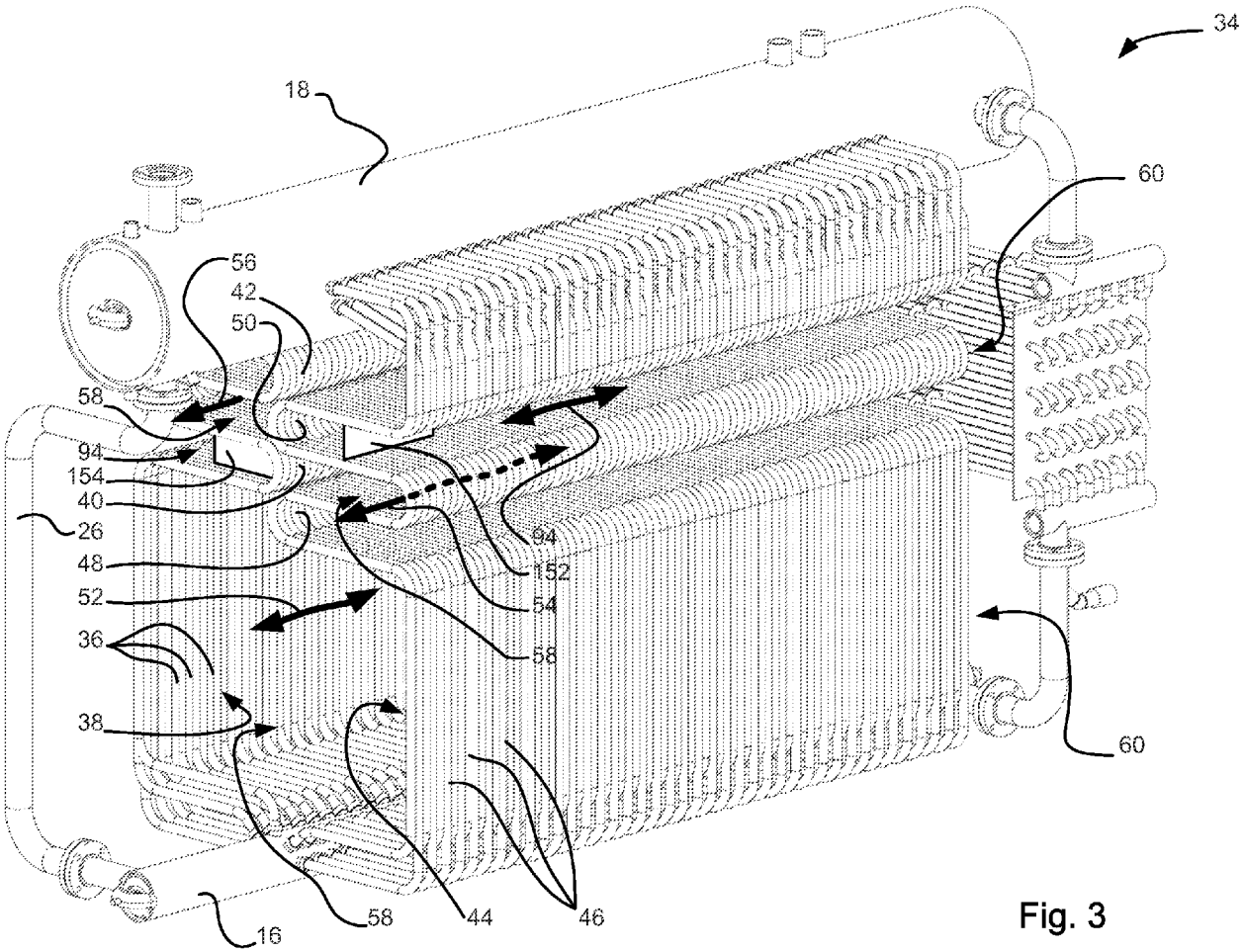
FIG. 3 is a front perspective of a tube arrangement 34 of the boiler 10.

Referring to FIG. 3, there is shown a tube arrangement 34 of the boiler 10 according to an embodiment. The tube arrangement 34 comprises a plurality of left tubes 36 for conveying the cold fluid. Each of the left tubes 36 fluidly connects the lower drum 16 and the upper drum 18. The tubes may be connected to the drums by welding directly or by means of ferrules. The left tubes 36 form a left wall 38. According to an embodiment, each of the left tubes 36 comprises two right inwardly extending portions 40, 42 each extending toward a right wall 44. The tube arrangement 34 further comprises a plurality of right tubes 46 for conveying the cold fluid. Each of the right tubes 46 fluidly connects the lower drum 16 and the upper drum 18. The right tubes 46 form the right wall 44 facing the left wall 38. According to an embodiment, each of the right tubes 46 comprises two left inwardly extending portions 48, 50, each extending toward the left wall 38.

The right inwardly extending portion 40 is contiguous to and staggered with the left inwardly extending portion 48 and the left inwardly extending portion 50, forming three passages 52, 54, 56 between the left wall 38 and the right wall 44. Of course all references to the left and the right are for convenience of description only. They can be reversed depending of the observer's point of view. This description is therefore meant to cover any mirror image of the device shown in the Figures.

Each one of the three passages 52, 54, 56 has first end 58 and second end 60 and are substantially isolated from each other between each of its respective first and second ends 58, 60. In use, the hot fluid circulates in the three passages 52, 54, 56 and heats the left tubes 36 and the right tubes 46, thereby heating the cold fluid. According to another embodiment, there are only one left inwardly extending portion and one right inwardly extending portion which are contiguous and staggered and which would create at least two passages.

The passages 52, 54, 56 are substantially isolated from each other. The left tubes 36 are substantially contiguous between themselves along their length. The right tubes 46 are similarly disposed. Moreover, the right inwardly extending portion 40 is proximate to or in contact with the left inwardly extending portion 48 and the left inwardly extending portion 50. In another embodiment (not shown), insulation is disposed between the tubes.

Figure 4:
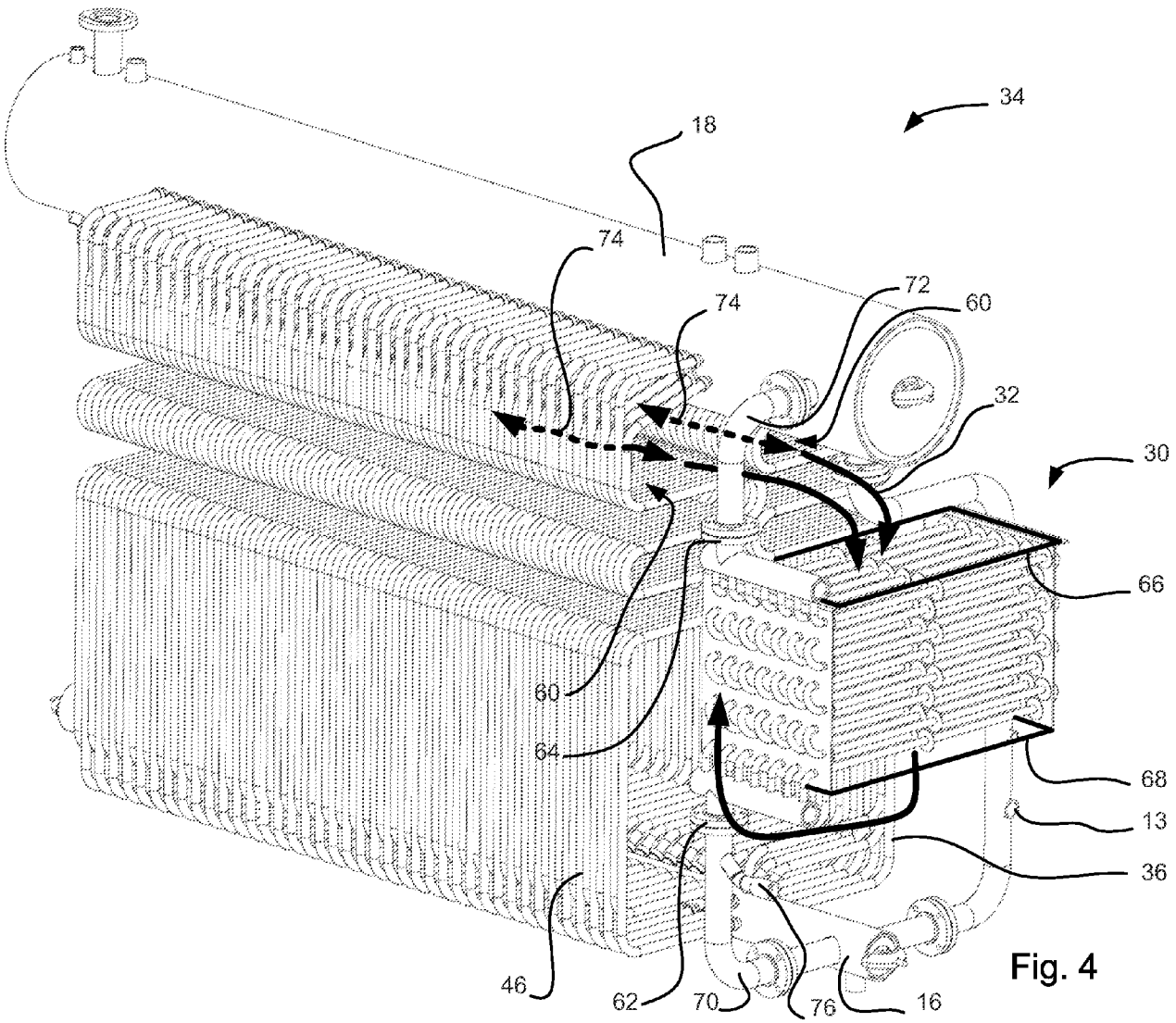
FIG. 4 is a rear perspective of the tube arrangement 34.

Turning now to FIG. 4, there is shown the tube arrangement 34 including the piping of the economizer 30. The economizer 30 is located between the lower drum 16 and the upper drum 18 and comprises a cold inlet 62, a cold outlet 64, a hot inlet 66 and a hot outlet 68. The cold inlet 62 is fluidly connected to the lower drum 16 by a lower piping 70. The cold outlet 64 is fluidly connected to the upper drum 18 by an upper piping 72. The hot inlet 66 is fluidly connected to second end 60 of upper passages 74 for receiving the previously cooled hot fluid 32. The hot inlet 66 is above the hot outlet 68, so that the previously cooled hot fluid 32 has a downward movement while the cold fluid has an upward movement. According to another embodiment, the hot inlet 66, the hot outlet 68, the cold inlet 62 and the cold outlet 64 can be reversed.

In use, the previously cooled hot fluid 32 circulates through the economizer 30 and exhausts by the hot outlet 68. The cold fluid, due to a difference in temperature between a cold inlet 62 and a cold fluid outlet 64, naturally flows upward from the lower drum 16 to the upper drum 18 crossing the economizer/additional exchanger 30 thereby heating the cold fluid. Such a disposition does not need any external assistance like a pump to be operative. An additional inlet 76 is fluidly connected to the cold inlet 62 for receiving additional cold fluid in the boiler 10 and inserting the additional cold fluid directly in the economizer 30 for pre-heating it before circulating in the tube arrangement 34. The additional inlet 76, can also receive the cold fluid flowing back from the network instead of the boiler inlet 13.

Figure 5:
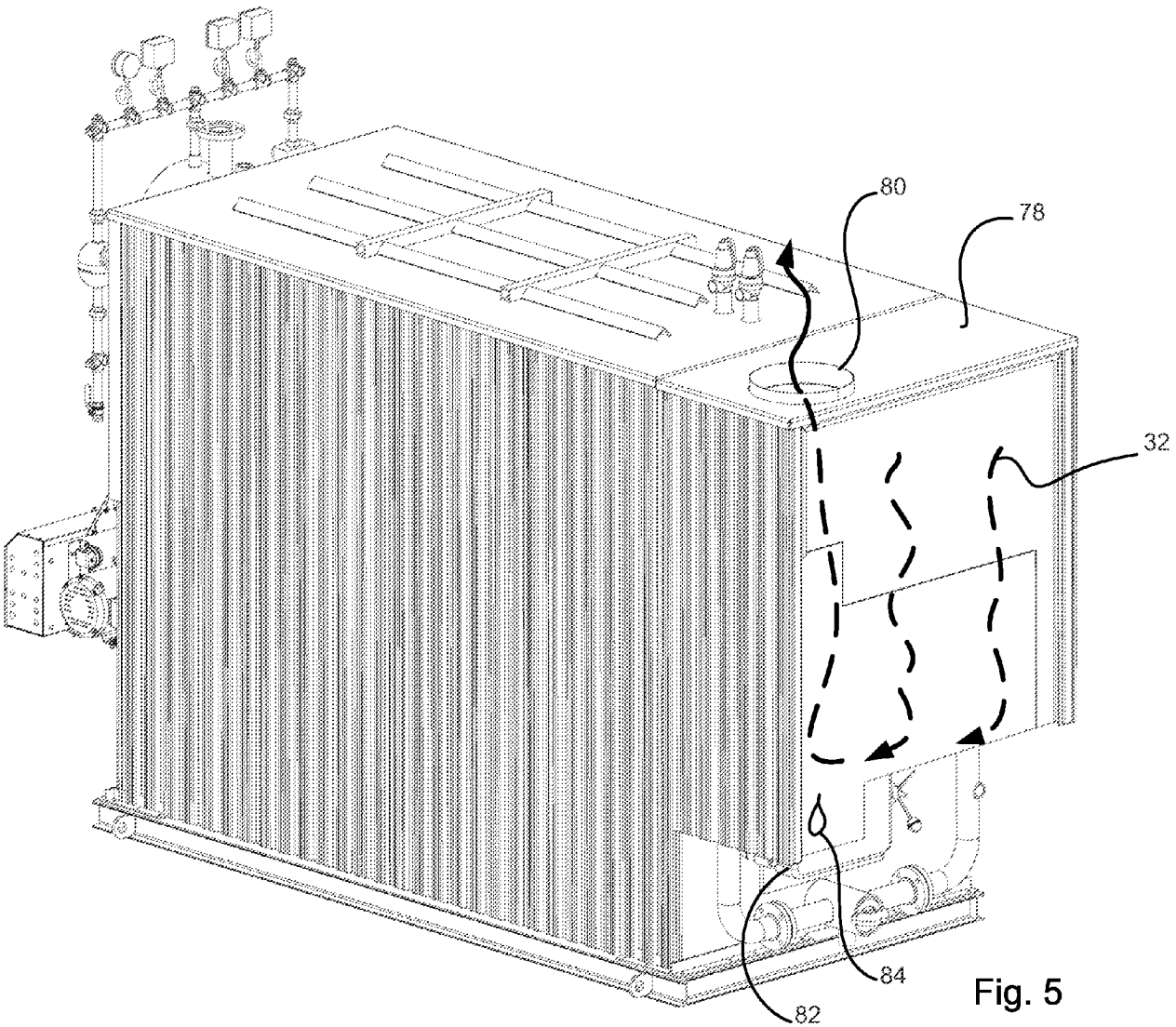
FIG. 5 is a rear perspective of the boiler 10.

Referring now to FIG. 5, there is shown the rear of the boiler 10. A duct 78 is disposed for receiving the previously cooled hot fluid 32, for conveying it to the hot inlet, not shown, for receiving the previously cooled hot fluid 32 from the hot outlet, not shown, and for exhausting it by a hot fluid output 80. A receptacle 82 is disposed at the bottom for receiving condensates 84.

Figure 6:
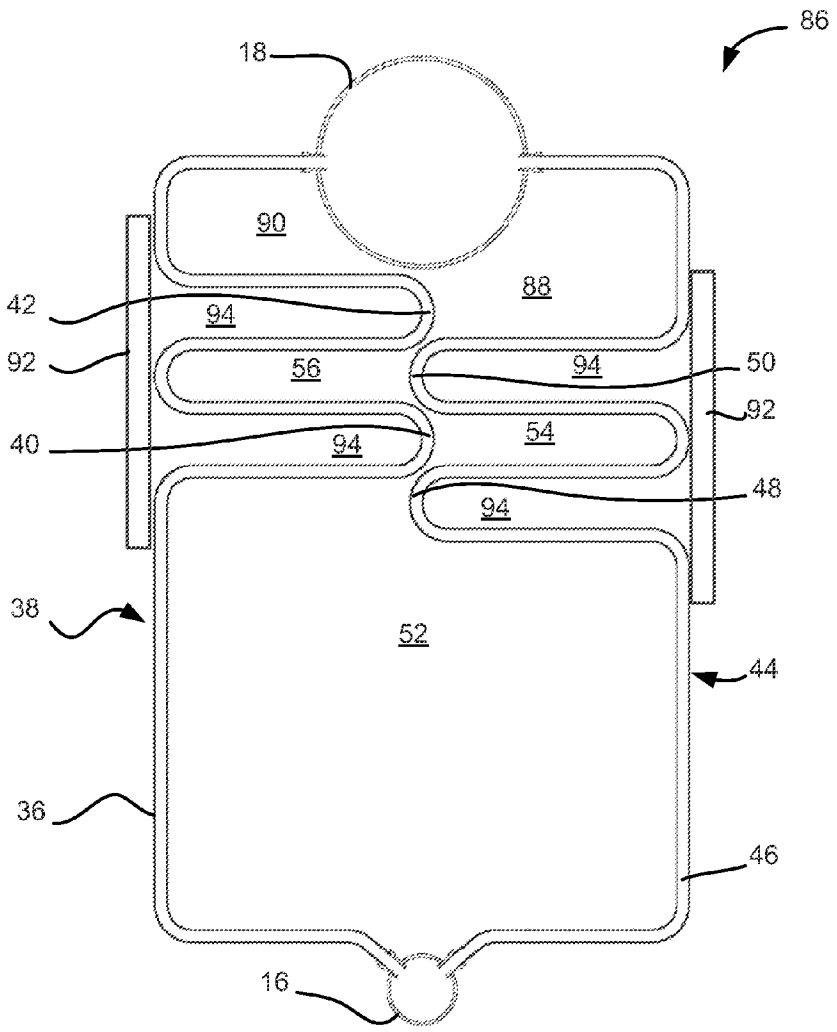
FIG. 6 is a scheme of a pattern 86 of tubes of the boiler 10.

Referring now to FIG. 6, there shown a pattern 86 of one of the left tubes 36 and one of the right tubes 46 fluidly connecting the lower drum 16 and the upper drum 18. The right inwardly extending portion 40 is contiguous to the left inwardly extending portion 48 and to the left inwardly extending portion 50, such that three passages 52, 54, 56 are formed between the left wall 38 and the right wall 44. The left inwardly extending portion 50 is contiguous to the right inwardly extending portion 40 and to the right inwardly extending portion 42, such that three passages 54, 56, 88 are formed between the left wall 38 and the right wall 44. The right inwardly extending portion 42 is contiguous to the upper drum 18, such that two passages 88, 90 are formed between the left wall 38 and the right wall 44.

Side plates 92 are disposed outside and against the left wall 38 and the right wall 44 forming four additional passages 94 with the right inwardly extending portions 40, 42 and the left inwardly extending portions 48, 50. Such a pattern results in nine passages 52, 54, 56, 88, 90, 94 with two right inwardly extending portions 40, 42 and two left inwardly extending portions 48, 50.

Figure 7:
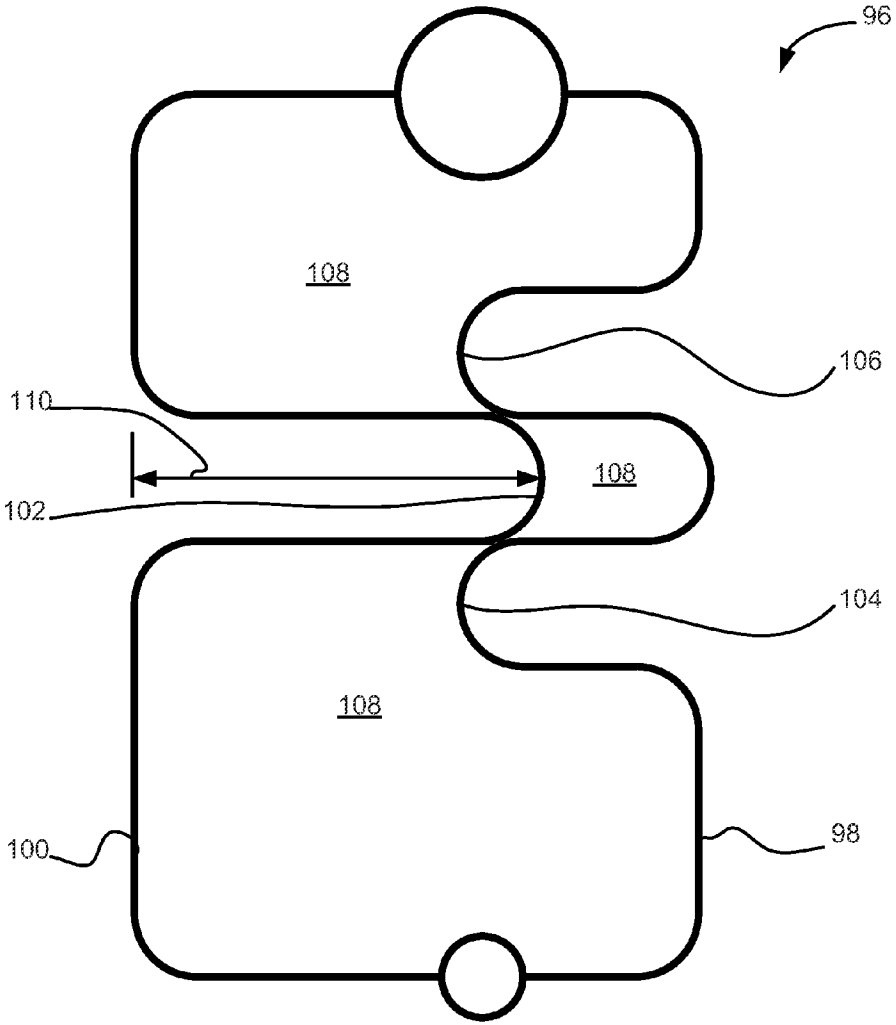
FIG. 7 is a scheme of a pattern 96 in accordance with another embodiment.

Referring now to FIG. 7, there is shown a pattern 96 of a right tube 98 and a left tube 100 according to another embodiment. A right inwardly extending portion 102 is contiguous to a left inwardly extending portion 104 and to another left inwardly extending portion 106, so that three passages 108 are formed. The right inwardly extending portion 102 is longer than the left inwardly extending portions 104, 106. Sections of the passages 108 depend on a length 110 of each inwardly extending portion.

Figure 8:
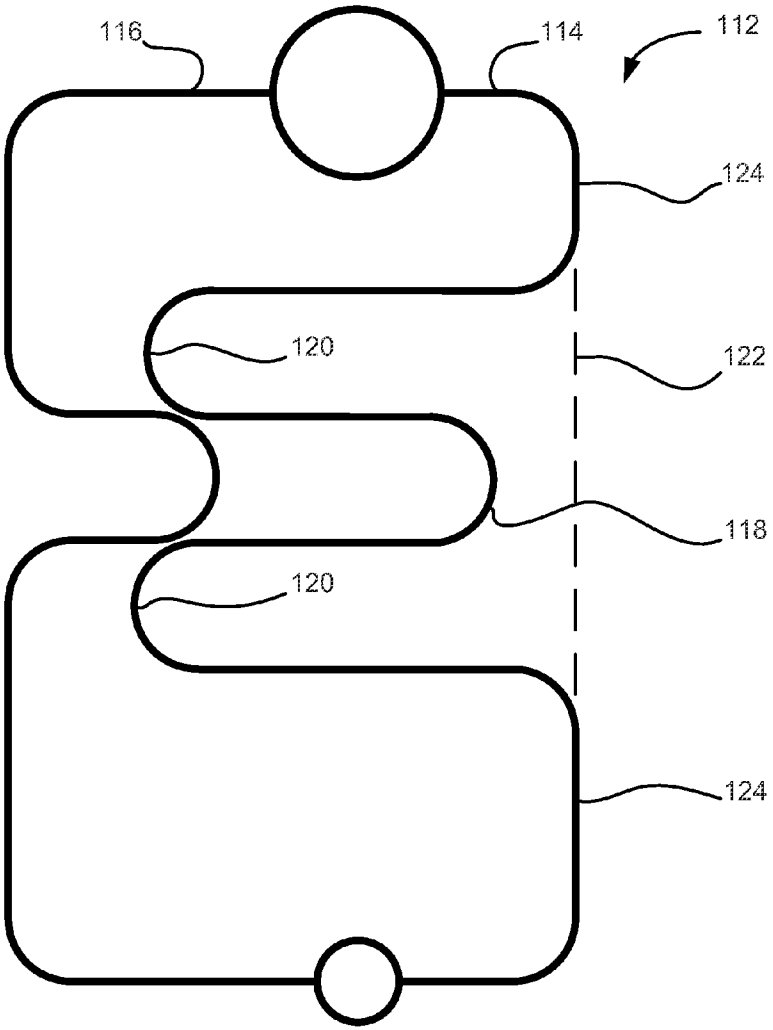
FIG. 8 is a scheme of a pattern 112 in accordance with another embodiment.

Referring now to FIG. 8, there is shown a pattern 112 of a right tube 114 and a left tube 116 according to another embodiment. A base portion 118 of the right tube 114, comprised between two left inwardly extending portions 120, is distant to a virtual base plan 122 comprising other base portions 124 of the right tube 114.

Figure 9:
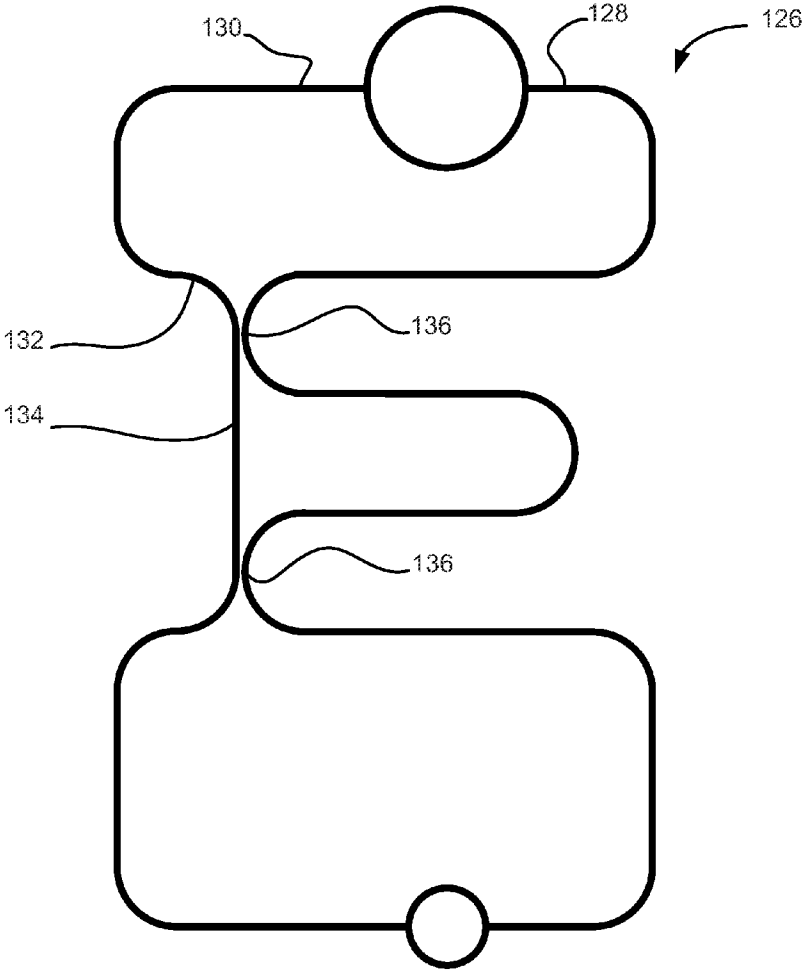
FIG. 9 is a scheme of a pattern 126 in accordance with another embodiment.

Referring now to FIG. 9, there is shown a pattern 126 of a right tube 128 and a left tube 130 according to another embodiment. A right inwardly extending portion 132 comprises a flat portion 134 which is contiguous to two left inwardly extending portions 136.

Figure 10:
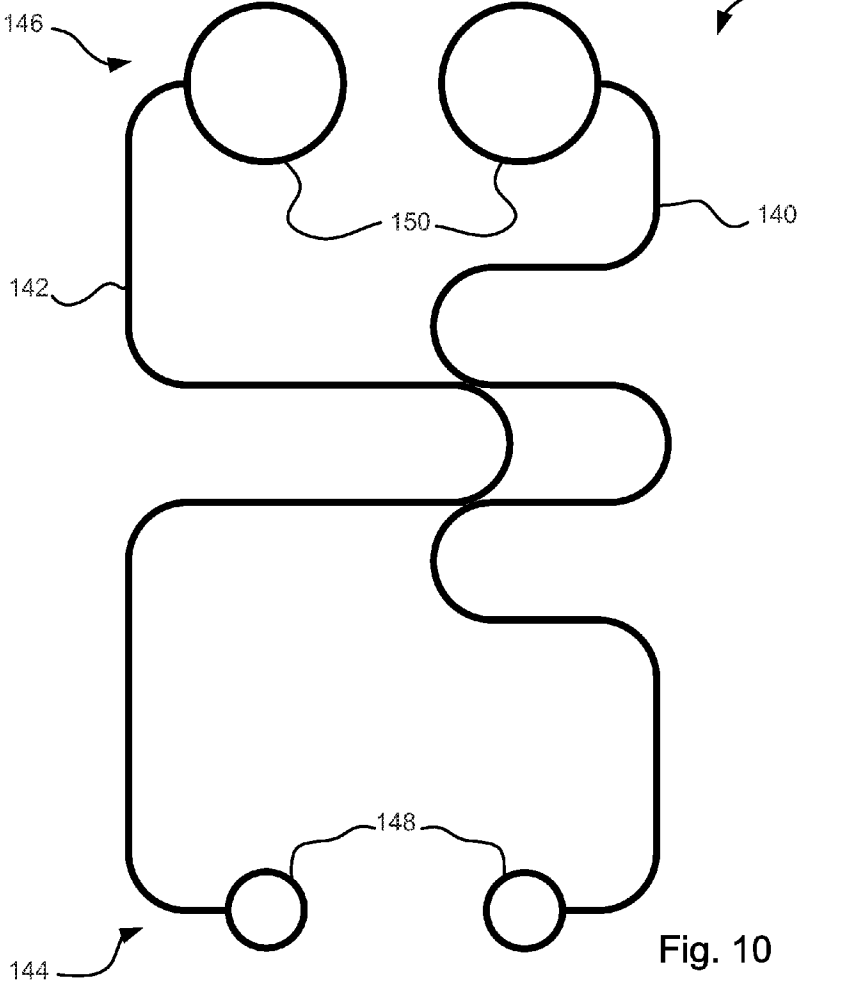
FIG. 10 is a scheme of a pattern 138 in accordance with another embodiment.

Referring now to FIG. 10, there is shown a pattern 138 of a right tube 140 and a left tube 142 according to another embodiment. The right tube 140 and the left tube 142 fluidly connect a lower drum 144 and an upper drum 146. The lower drum 144 comprises two lower manifolds 148 fluidly connected between themselves. Similarly, the upper drum 146 comprises two upper manifolds 150 fluidly connected between themselves. The right tube 140 fluidly connects one of the lower manifolds 148 to one of the upper manifold 150 and the left tube 142 fluidly connects the other lower manifold 148 to the other upper manifold 150.

Returning now to FIG. 3, the tube arrangement 34 further comprises a dividing plate 152 disposed along the passage 94 for dividing a circulation of the hot fluid in a portion of the at least one passage in two separate fluxes. The tube arrangement 34 further comprises a limiting plate 154 disposed across the passage 94, limiting a section of a portion of passage 94.

Returning now to FIG. 1, the boiler 10 further comprises an end wall 156 disposed at one end 60 of the passages 52, 94, 54, fluidly connecting the passages 52, 94, 54. The end wall 156 comprises a cavity 158 allowing the hot fluid 24 to pass from the passage 52 to passages 94, 54 by the cavity 158. Other arrangements for cavity 158 are possible where the hot fluid 24 passes from passage 52 to passage 94, but not to passage 54. Cavity 158 can also be arranged to provide an end passage between two single longitudinal passages or any other combination (e.g., two passages to one, two passages to two, etc.). According to dispositions of cavities in the end walls, several circulations of hot fluid are envisioned as unexclusively depicted on FIG. 11, FIG. 12 and FIG. 13, concurrently referred to.

Figure 11:
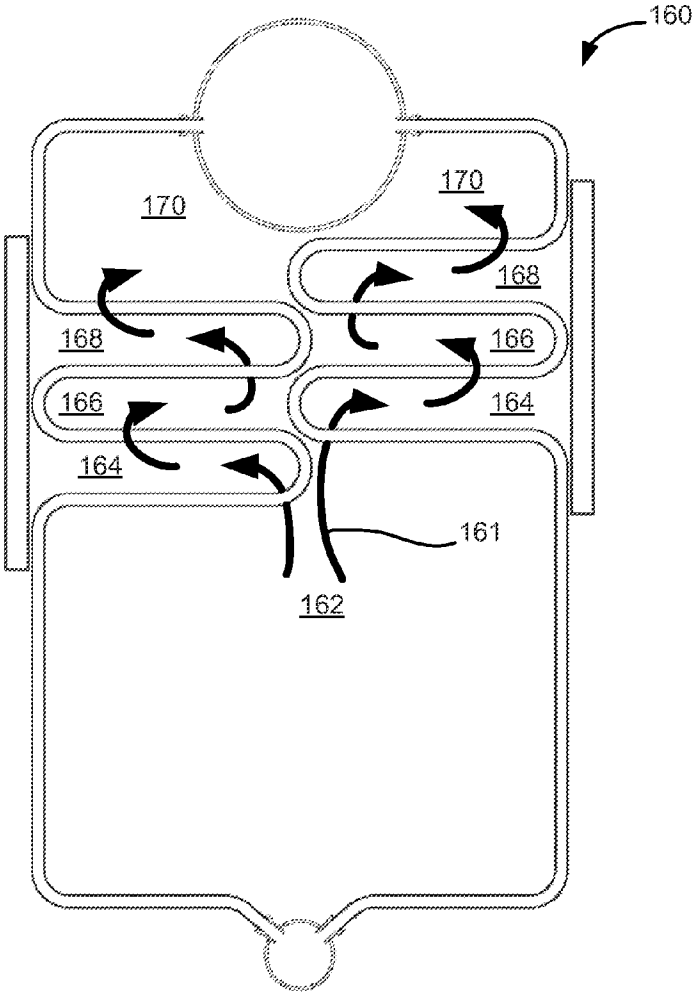
FIG. 11 is a schematic view of a circulation of a hot fluid in a boiler in accordance with another embodiment.

FIG. 11 shows a circulation 160 according to another embodiment. A hot fluid 161 is generated in a passage 162 and divided into two passages 164 in the back. In the front, the hot fluid 161 is transferred from the two passages 164 into two passages 166. In the back, the hot fluid 161 is transferred from the two passages 166 into two passages 168. In the front, the hot fluid 161 is transferred from the two passages 168 into two passages 170. Each portion of the hot fluid crosses through five passages in the boiler.

Figure 12:
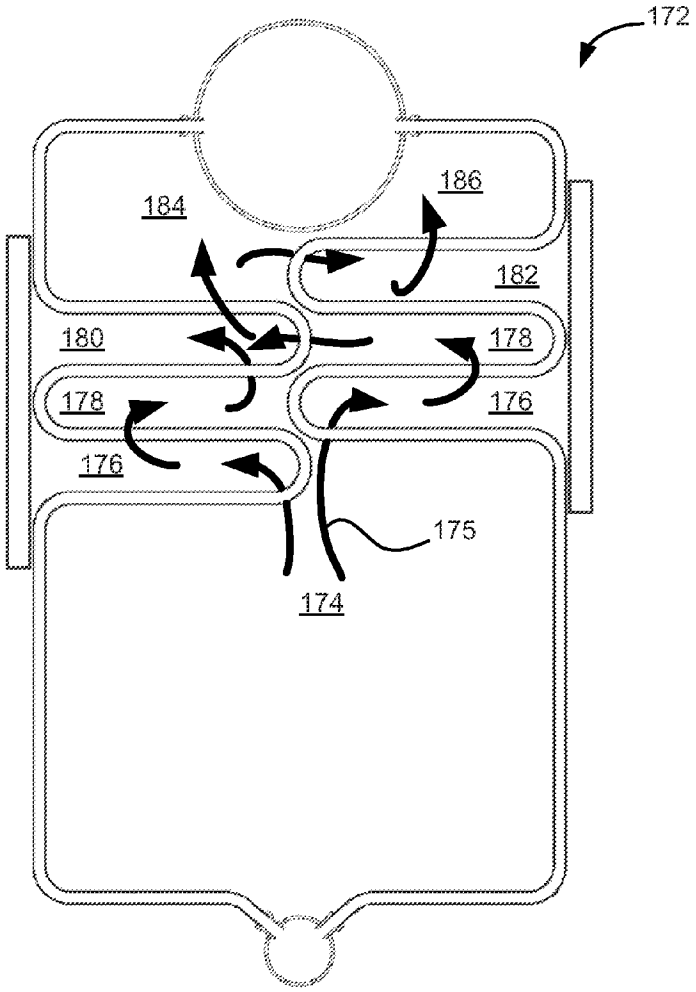
FIG. 12 is a schematic view of a circulation of a hot fluid in a boiler in accordance with another embodiment.

FIG. 12 shows a circulation 172 according to another embodiment. A hot fluid 175 is generated in a passage 174 and divided into two passages 176 in the back. In the front, the hot fluid 175 is transferred from the two passages 176 into two passages 178. In the back, the hot fluid 175 is transferred from the two passages 178 into a passage 180. In the front, the hot fluid 175 is transferred from the passage 180 into a passage 184. In the back, the hot fluid 175 is transferred from the passage 184 into a passage 182. In the front, the hot fluid 175 is transferred from the passage 182 into a passage 186. Each portion of the hot fluid crosses through seven passages in the boiler.

Figure 13:
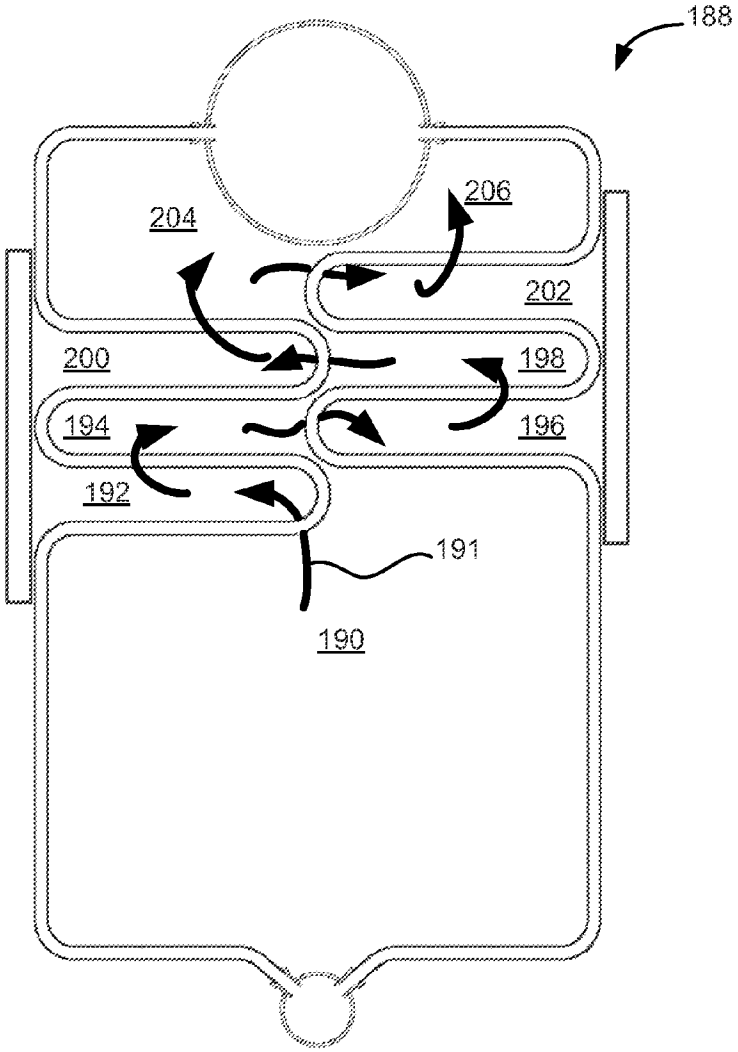
FIG. 13 is a schematic view of a circulation of a hot fluid in a boiler in accordance with another embodiment.

FIG. 13 shows a circulation 188 according to another embodiment. A hot fluid 191 is generated in a passage 190 and transferred into a passage 192 in the back. In the front, the hot fluid 191 is transferred from the passage 192 into a passage 194. In the back, the hot fluid 191 is transferred from the passage 194 into a passage 196. In the front, the hot fluid 191 is transferred from the passage 196 into a passage 198. In the back, the hot fluid 191 is transferred from the passage 198 into a passage 200. In the front, the hot fluid 191 is transferred from the passage 200 into a passage 204. In the back, the hot fluid 191 is transferred from the passage 204 into a passage 202. In the front, the hot fluid 191 is transferred from the passage 202 into a passage 206. Each portion of the hot fluid 191 travels through nine passages in the boiler.

While embodiments have been described above and illustrated in the accompanying drawings, it will be evident to those skilled in the art that modifications may be made therein without departing from the essence of this description. Such modifications are considered as possible variants comprised in the scope of the description.

The invention claimed is:

1. A boiler for heating a cold fluid with a hot fluid, the boiler comprising:

a lower drum;

an upper drum;

a plurality of right tubes for conveying the cold fluid, each of the right tubes fluidly connecting the lower drum and the upper drum, the right tubes forming a right wall, each of the right tubes comprising at least two left inwardly extending portions extending toward a left wall, an upper one of the at least two left inwardly extending portions defining a first upper apex associated thereto, a lower one of the at least two left inwardly extending portions defining a first lower apex associated thereto; and a plurality of left tubes for conveying the cold fluid, each of the left tubes fluidly connecting the lower drum and the upper drum, the left tubes forming the left wall facing the right wall, each of the left tubes comprising at least one right inwardly extending portion extending toward the right wall, the at least one right inwardly extending portion defining a second apex associated thereto;

wherein the second apex of the at least one right inwardly extending portion is contiguous to and vertically staggered between the first upper apex of the upper one of the at least two left inwardly extending portions and the first lower apex of the lower one of the at least two left inwardly extending portions thereby closing a gap between the at least two left inwardly extending portions and creating a first passage defined by the at least two left inwardly extending portions and the second apex of the at least one right inwardly extending portion between the plurality of right tubes and the plurality of left tubes.

2. The boiler of claim 1, wherein the at least one right inwardly extending portion or at least one of the at least two left inwardly extending portions is contiguous to the upper drum or to the lower drum forming a second passage additional to the first passage for the hot fluid between the right wall and the left wall.

3. The boiler of claim 1, wherein one of the at least one right inwardly extending portion and the at least two left inwardly extending portions is longer than a respective one of at least one of the at least two left inwardly extending portions and the at least one right inwardly extending portion.

4. The boiler of claim 1, further comprising a side plate disposed outside and against the right wall or the left wall forming at least third passage in addition to the first passage for the hot fluid with a respective one of the at least one right inwardly extending portion or at least one of the at least two left inwardly extending portions.

5. The boiler of claim 1, further comprising a dividing plate disposed along a portion of the first passage for dividing a circulation of the hot fluid in the portion of the first passage in two separate fluxes.

6. The boiler of claim 1, further comprising a limiting plate disposed across a section of a portion of the first passage limiting the section of the portion of the passage.

7. The boiler of claim 4, further comprising an end wall disposed at an end of the first passage and the third passage fluidly connecting the first passage and the third passage.

8. The boiler of claim 7, wherein the end wall comprises a cavity for allowing the hot fluid between the first passage and the third passage via the cavity.

9. The boiler of claim 1, wherein each of the plurality of right tubes and each of the plurality of left tubes comprises two left and right inwardly extending portions respectively.

10. The boiler of claim 1, wherein the lower drum comprises at least two fluidly connected lower manifolds.

11. The boiler of claim 1, wherein the upper drum comprises at least two fluidly connected upper manifolds.

12. The boiler of claim 1, further comprising an additional exchanger, the additional exchanger comprising:

a cold inlet fluidly connected to the lower drum receiving a cold fluid;

a cold outlet fluidly connected to the upper drum and the cold inlet, the cold fluid circulating upwardly from the cold inlet towards the cold outlet;

a hot inlet fluidly connected to the first passage for receiving a previously cooled hot gas; and a hot outlet fluidly connected to the hot inlet, the previously cooled hot gas circulating downwardly from the hot inlet towards the hot outlet;

wherein the previously cooled hot gas crosses the additional exchanger and exhausts by the hot outlet, the cold fluid, being subjected to a difference in temperature between the cold inlet and the cold outlet, flows upward from the lower drum to the upper drum crossing the additional exchanger thereby heating the cold fluid.

13. The boiler of claim 12, further comprising an additional inlet fluidly connected to the cold inlet, the additional inlet being for receiving additional cold fluid in the boiler and inserting the additional cold fluid directly in the additional exchanger.

14. The boiler of claim 12, wherein the cold inlet is connected to at least one of the lower drum and an additional cold fluid inlet.

15. A boiler for heating a cold fluid with a hot gas, the boiler comprising:

a lower drum;

an upper drum;

a plurality of tubes for conveying the cold fluid, each of the tubes fluidly connecting the lower drum and the upper drum, the tubes forming a first passage having first and second ends; and an additional exchanger, the additional exchanger comprising:

a cold inlet fluidly connected to the lower drum receiving a cold fluid;

a cold outlet fluidly connected to the upper drum and the cold inlet, the cold fluid circulating upwardly from the cold inlet towards the cold outlet;

a hot inlet fluidly connected to the first passage for receiving a previously cooled hot gas; and a hot outlet, below the hot inlet, fluidly connected to the hot inlet, the previously cooled hot gas circulating downwardly from the hot inlet towards the hot outlet;

wherein the previously cooled hot gas crosses the additional exchanger and exhausts by the hot outlet, the cold fluid, being subjected to a difference in temperature between the cold inlet and the cold outlet, flows upward from the lower drum to the upper drum crossing the additional exchanger thereby heating the cold fluid.

16. The boiler of claim 15, further comprising an additional inlet fluidly connected to the cold inlet, the additional inlet being for receiving additional cold fluid in the boiler and inserting the additional cold fluid directly in the additional exchanger.

17. A boiler for heating a cold fluid with a hot gas, the boiler comprising:

an additional exchanger, the additional exchanger comprising:

a cold inlet connected to the boiler and for receiving a cold fluid from;

a cold outlet fluidly connected to the cold inlet and located above the cold inlet, the cold fluid circulating upwardly from the cold inlet towards the cold outlet;

a hot inlet for receiving a previously cooled hot gas by the boiler; and a hot outlet, below the hot inlet, the previously cooled hot gas circulating downwardly from the hot inlet towards the hot outlet;

wherein the previously cooled hot gas crosses the additional exchanger and exhausts by the hot outlet, the cold fluid, being subjected to a difference in temperature between the cold inlet and the cold outlet, flows upward from a lower level to an upper level crossing the additional exchanger thereby heating the cold fluid.

* * * * *